US005738279A

United States Patent [19]

Ihle et al.

[11] Patent Number: 5,738,279

[45] Date of Patent: Apr. 14, 1998

[54] ELASTIC TRACK FOUNDATION

[75] Inventors: Erich Ihle; Heinz Völker, both of Wadern, Germany

[73] Assignee: Saar-Gummiwerk GmbH, Wadern-Büschfeld, Germany

[21] Appl. No.: 188,315

[22] Filed: Jan. 28, 1994

[30] Foreign Application Priority Data

Jan. 28, 1993 [DE] Germany ..... 43 02 298.7

[51] Int. Cl.[6] ..... E01B 9/00

[52] U.S. Cl. ..... 238/382; 238/2; 238/283

[58] Field of Search ..... 238/382, 283, 238/8

[56] References Cited

U.S. PATENT DOCUMENTS

| | | | |
|---|---|---|---|
| 4,461,421 | 7/1984 | Maass | 238/8 |
| 4,606,498 | 8/1986 | Grant et al. | 238/8 |
| 4,723,706 | 2/1988 | Ortwein | 238/283 |

FOREIGN PATENT DOCUMENTS

| | | |
|---|---|---|
| 352164 | 9/1979 | Austria . |
| 2926658 | 2/1980 | Germany . |
| 3137187 | 3/1983 | Germany . |
| 3148710 | 7/1983 | Germany . |

*Primary Examiner*—Mark T. Le

*Attorney, Agent, or Firm*—James Creighton Wray; Meera P. Narasimhan

[57] ABSTRACT

An elastic, essentially plate-shaped track foundation consists of closed-pored foamed and crosslinked rubber material, preferably EPDM rubber. The foaming and crosslinking preferably is performed in one working step.

8 Claims, 1 Drawing Sheet

ELASTIC TRACK FOUNDATION

BACKGROUND OF THE INVENTION

The invention relates to an elastic, essentially plate-shaped track foundation of foamed material.

Elastic track foundations are preferably used in the installation of tracks on solid driving surfaces, but also for installation in the ballast as an intermediate support between track and railroad tie, or between railroad tie and substructure, in order to elastically spring the installed tracks when a train passes over them. Elasticity and spring characteristic of the intermediate support must be adapted to the respective attachment system, as well as to axle load and speed of the trains. A springing of the tracks during train passage of approximately 1.0 to 1.5 mm was found advantageous for a good load distribution over several railroad ties.

Known track foundations of compact rubber have projecting knobs or a molded-in groove or ridge structure in the stressed area of their surfaces. With these incompressible track foundations, the elasticity or progression of the spring characteristic is determined by the deformation of the knobs or ridges.

A disadvantage of this known track foundation is that water and dirt are able to penetrate into the spaces between the knobs or into the grooves and may fill them. This causes a significant adverse effect on the elasticity of the track foundation and alters the spring characteristic. In addition, the incompressible material is destroyed over time by the flexing work which must be absorbed during strain. Another disadvantage is that the spring characteristic, especially in the case of larger forces, does not have a linear progression.

Also known are track foundations made of foamed EVA polymer. These track foundations indeed are not susceptible to destruction due to flexing work or to an alteration of the spring characteristic due to dirt. But their temperature resistance is too low. When stored at higher temperatures or in the sun, or even if the sun shines on installed track foundations, an impermissible change in the spring characteristic may occur. In addition, EVA polymer tends to creep under strain, i.e. suffers permanent deformations.

SUMMARY OF THE INVENTION

It is the task of this invention to provide a track foundation that avoids these disadvantages.

This task is solved for a track foundation of the initially mentioned type in that the track foundation consists of a closed-pored foamed and crosslinked rubber material.

It is preferred that the track foundation is made of EPDM rubber.

Compared to the known track foundation made from foamed EVA polymer, the track foundation of the invention has the following advantages:

- less shrinkage and thus better geometric resistance at higher temperatures,
- negligible alteration of the spring characteristic, even under a longer influence of higher temperatures, e.g. during storage and also in the installed state,
- small influence of temperature fluctuations on the spring characteristic in a broad temperature range, e.g. from −30° to approximately 70° C.,
- reduction of permanent deformations following strain.

Compared to track foundations of compact rubber with knobs or groove structure, the track foundation according to the invention is also characterized by

- a longer lifespan, since the foam structure eliminates flexing work,
- a more linear spring characteristic over a wide strain range,
- no deterioration of elasticity or of the spring characteristic due to dirt.

The track foundation according to the invention is made by the closed-pored foaming of crosslinked rubber, whereby it is useful that the foaming process and the crosslinking of the material are performed in one working step.

The desired spring characteristic of the track foundation hereby can be achieved in a simple manner by the degree of foaming. Depending on the specific weight of the parts, larger or smaller pores are present in the foam structure. Since these pores are always closed-celled, water or dirt are not able to penetrate to the inside if the external skin is detached or injured and thus are unable to alter the dynamic properties.

It may be useful that the surfaces of the track foundation are constructed as cover layers made of unfoamed or only slightly foamed material. But this cover layer should be kept very thin so that it will not influence the elasticity of the foamed part. The ratio of the thickness of the foamed central part to the thickness of the cover layer can be determined by way of the production parameters. This makes it possible to also construct relatively thin track foundations, e.g. with a thickness of 5 mm, with a significantly higher degree of elasticity than comparable track foundations that are made of compact rubber and have an elasticity that is defined by the surface geometry, e.g. knobs.

The track foundation according to the invention in this way can be produced directly in its final form in one tool. But it is also possible to punch track foundations from prefabricated plates or webs.

DETAILED DESCRIPTION OF THE DRAWINGS

Figure 1:
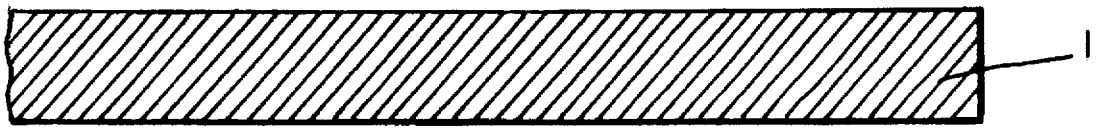
FIGS. 1 to 3 show possible designs of the track foundations according to the invention.

FIG. 1 shows a cross-section through track foundation 1 according to the invention, constructed as a single, level plate.

Figure 2:
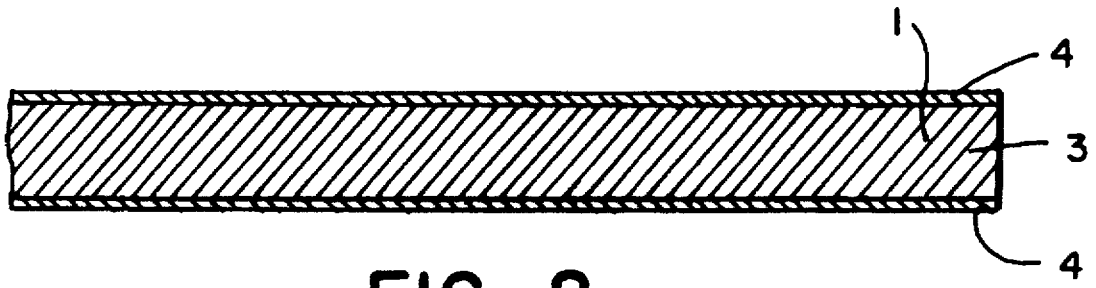

FIG. 2 shows a cross-section through a track foundation 1 according to the invention, with an inner foamed part 3 and the unfoamed or only slightly foamed cover layers 4.

Figure 3:
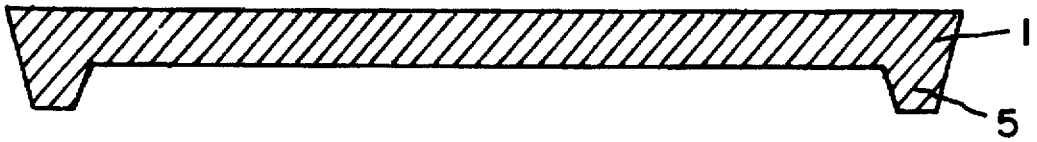

FIG. 3 shows a cross-section through a track foundation 1 that is equipped with lateral support tabs 5.

We claim:

1. Elastic, essentially plate-shaped track foundation of foamed material, characterized in that the track foundation (1) consists of a closed-pored foamed and crosslinked rubber material.

2. Track foundation as claimed in claim 1, characterized in that the track foundation (1) consists of EPDM rubber.

3. Track foundation as claimed in claim 1, characterized in that the track foundation (1) is made by the closed-pored foaming and crosslinking of the material in one working step.

4. Track foundation as claimed in claim 1, characterized in that the track foundation (1) has cover layers (4) of unfoamed material that form the bottom and top plate surface.

5. Elastic track foundation for mounting rails comprising foundations having generally planar surfaces, and the foundations being of closed-pored foamed and crosslinked rubber material.

6. The track foundation of claim 5, wherein the foundations consist of EPDM rubber.

7. The track foundation of claim 1, wherein the foundations comprise the closed-pored foaming and the crosslinked material being formed in one working step.

8. The track foundation of claim 1, further comprising first and second layers of unfoamed material on bottom and top sides of the foundation surfaces.

* * * * *